United States Patent [19]

Kajiwara et al.

[11] Patent Number: 5,073,743

[45] Date of Patent: Dec. 17, 1991

[54] ELECTRODE FOR DISCHARGE LIGHT SOURCE

[75] Inventors: Toshiro Kajiwara; Goroku Kobayashi; Keiji Fukuyama; Ko Sano; Yojiro Yano; Keiji Watanabe, all of Kanagawa, Japan

[73] Assignee: Mitsubishi Denki Kabushiki Kaisha, Tokyo, Japan

[21] Appl. No.: 432,777

[22] Filed: Nov. 1, 1989

[30] Foreign Application Priority Data

Mar. 20, 1989 [JP] Japan ..... 64-297

[51] Int. Cl.[5] ..... H01J 19/06; H01J 17/04

[52] U.S. Cl. ..... 313/346 R; 313/355; 313/310; 313/103 R

[58] Field of Search ..... 313/346 R, 355, 310, 313/103 R, 632; 252/521

[56] References Cited

U.S. PATENT DOCUMENTS

| | | | |
|---|---|---|---|
| 4,260,525 | 4/1981 | Olsen et al. | 252/521 |
| 4,599,076 | 7/1986 | Yokono et al. | 313/355 X |
| 4,600,397 | 7/1986 | Kawakubo et al. | 313/355 X |

OTHER PUBLICATIONS

Sakai et al., "Gas Discharge Panel . . . Cathode (II)", Inst. of Elec. and Comm. Engs. of Japan, ED81-25, pp. 61-66, 1981.

Kamegaya et al., "Putting into Low Voltage . . . Panel", Inst. of Telecomm. Engs., ED-572, pp. 55-60, 1982.

M. O. Aboelfotoh, "Aging Characteristics of AC . . . Panels", Proc. SID, 22/4, pp. 219-227, 1981.

H. D. Hagstrum, "Theory of Auger Ejection . . . by Ions", Phys. Rev., 96(2), pp. 336-365, Jun. 16, 1954.

S. Yamamoto et al., "Work Function of Binary Compounds", J. Chem. Phys., 60(10), pp. 4076-4080, May 16, 1974.

*Primary Examiner*—Sandra L. O'Shea
*Assistant Examiner*—Michael Horabik
*Attorney, Agent, or Firm*—Burns, Doane, Swecker & Mathis

[57] ABSTRACT

An electrode for discharge light source which is suitable for discharge display on account of its high reliability and outstanding discharge characteristics attributable to the metal conductor which is formed 1-5 μm thick in the discharge container and also to the film of the material for secondary emission which is formed on the metal conductor from a compound composed of $LaB_6$ and Ba in an amount of 0.01-20 mol % of $LaB_6$ or a compound composed of $LaB_6$, Ba in an amount of 0.01-20 mol % of $LaB_6$, and Ca in an amount of 0.01-5 mol % of Ba, and is 0.5-2 μm thick so that it is free of pin-holes.

2 Claims, 2 Drawing Sheets

ELECTRODE FOR DISCHARGE LIGHT SOURCE

TECHNICAL FIELD

The present invention relates to an electrode for discharge light sources such as discharge displays which contributes to improvements in characteristics such as firing potential and emission luminance, of discharge light sources.

BACKGROUND ART

Electrodes for discharge light sources, such as cathodes for cold cathode discharge, are usually made of Ni, Ni-Fe, Ni-Cr-Cu, or the like, which have a good efficiency with respect to secondary emission, so that low firing potential and high emission luminance are achieved.

The cathode for cold cathode discharge is now required to have a higher performance with respect to secondary emission as discharge displays come into practical use.

To meet this requirement, it has become a common practice to make the cathode for cold cathode discharge from a material composed of a metal conductor and an alloy or metal oxide laminated thereon, which has a high efficiency with respect to secondary emission Examples of the alloy or metal oxide (for secondary emission) to be laminated on the metal conductor include BaAl (described in the Institute of Electronics and Communication Engineers of Japan, ED81-25, pp. 61–66, 1981, Sakai et.al.), LaB6 (described in the research paper of the Institute of Telecommunications Engineers, ED-572, pp. 55–60, 1982, Kamegaya et.al.), and MgO (disclosed in Proc. SID, 22/4, pp. 219–227, 1981, M. O. Aboeifoth).

The conventional electrode for discharge light source is shown in section in FIG. 4. The electrode is attached to the discharge container 1 enclosing a rare gas alone or a rare gas containing mercury vapor which is necessary for discharging. The discharge container 1 also functions as a glass substrate.

The inside wall of the discharge container 1 is coated with a fluorescent material 2, and the substrate of the discharge container 1 is provided with a metal conductor 3.

The metal conductor 3 is made of Al or Ni, and its surface has a deposited film 5 of secondary emission material.

The film 5 of secondary emission material forms a cathode for a discharge light source.

The function is described in the following. The application of a voltage (necessary for discharging) to the metal conductor 3 gives kinetic energy to initial electrons which have already been generated by photoionization in the discharge container 1, causing them to ionize the rare gas or the mercury vapor-containing rare gas, thereby generating ions and electrons. The thus generated initial ions collide with the film 5 of the material for secondary emission (which functions as the cathode) to generate secondary electrons. These electrons move to the anode, and each time when they collide with neutral atoms during their move, they generate electrons or excited atoms in geometrical progression, permitting the self-maintaining discharge. It follows, therefore, that the smoother and more large the generation of initial electrons, the less the energy to be injected for discharging (initial firing potential) and the energy to be injected for maintaining discharge (discharge maintaining voltage). In other words, it is possible to realize a highly efficient discharge light source or discharge display by employing the film 5 of the material for secondary emission which efficiently emits secondary electrons when hit by ions.

In the meantime, it is known that the secondary emission caused by ion collision occurs according to the Auger neutralization mechanism and the Auger de-excitation mechanism (as described by H. D. Hagstrum in Phys, Rev., 96(2), pp. 336–365, 1954. It is also known that these mechanisms permit more secondary emission as the solid metal decreases in work function $\Phi$ (ease of transition from Fermi level to valence band) and Fermi level $\delta_F$(Fermi energy measured from the bottom of the conduction band).

For this reason, efforts are being made to reduce the work function of the material for secondary emission in order to lower the firing potential and to increase the efficiency.

Table 1 shows the work function (eV) of typical materials for secondary emission, which was taken from J. Chem. Phys. 60 (10), pp. 4076–4080, 1974, S. Yamamoto et. al.

TABLE 1

| Ni | Fe | Ba | MgO | $LaB_6$ |
|---|---|---|---|---|
| 4.96 | 4.49 | 2.51 | 4.20 | 3.20 |

The conventional electrode for discharge light source is constructed as mentioned above, and, in practice, it is made of $La_6$ B or MgO having a low work function as the material for secondary emission These materials, however are not necessarily satisfactory in the rate of secondary emission, and this prevents the apparatus from being improved in performance such as higher brightness and lower discharge voltage.

A conceivable way of coping with this is to use Ba, which has a higher rate of secondary emission than $LaB_6$ and MgO. Unfortunately, Ba in the form of simple substance is so chemically active that it reacts with the constituent materials such as metal conductor 3 and fluorescent material 2, reducing the life of the apparatus, and it readily reacts with moisture and oxygen in air to form BaO while the apparatus is being produced Therefore, Ba does not provide stable performance Disclosure of the invention:

It is an object of the present invention to provide an electrode for discharge light source having stable performance and high reliability in order to lower the firing potential, increase the energy conversion efficiency, and raise the brightness, while keeping the high rate of secondary emission, without reducing the life of the apparatus and causing such troubles as the formation of BaO in the course of apparatus production.

This object is achieved by an electrode for discharge light source, which is characterized in that the metal conductor formed in the discharge container in which a rare gas is enclosed is 1-5 $\mu$m thick, and the film of the material for secondary emission formed on the metal conductor is made of a compound composed of LaB and Ba in an amount of 0.01--20 mol % of $LaB_6$ and is 0.5–2 $\mu$m thick.

The above described electrode for discharge light source has the following features The metal conductor having a thickness limited to 1–5 $\mu$m withstands the discharge current of tens of mA. The film of the material for secondary emission which is formed on the metal conductor from a compound composed of $LaB_6$ and Ba in an amount of 0.01-20 mol % of $LaB_6$ provides the electrode for discharge light source which has good heat resistance, chemical stability, and superior secondary emission characteristics. In addition, the film of the material for secondary emission which has a thickness limited to 0.5-2 μm exhibits its performance fully, without suffering from pin-holes.

In a second embodiment, the electrode for discharge light is characterized in that the film of the material for secondary emission is made of a compound composed of $LaB_6$, Ba in an amount of 0.01-20 mol % of $LaB_6$, and Ca in an amount of 0.01-5 mol % of Ba, and is 0.5-2 μm thick.

The second embodiment of the electrode for discharge light sources has the following features. The film of the material for secondary emission which is formed from a compound composed of $LaB_6$, Ba in an amount of 0.01-20 mol % of $LaB_6$, and Ca in an amount of 0.01-5 mol % of Ba and is 0.5-2 μm thick provides the electrode which is chemically stable over a long period of time and easy to handle and has an extremely high rate of secondary emission. This lowers the firing potential and increases the energy conversion efficiency.

BEST MODE FOR CARRYING OUT THE INVENTION

Figure 1:
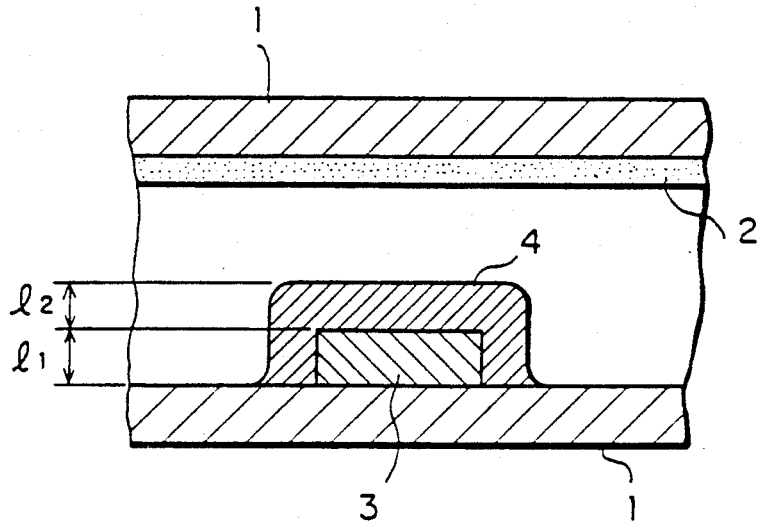
FIG. 1 is a sectional view showing the electrode for discharge light source in an embodiment of the present invention.
Figure 4:
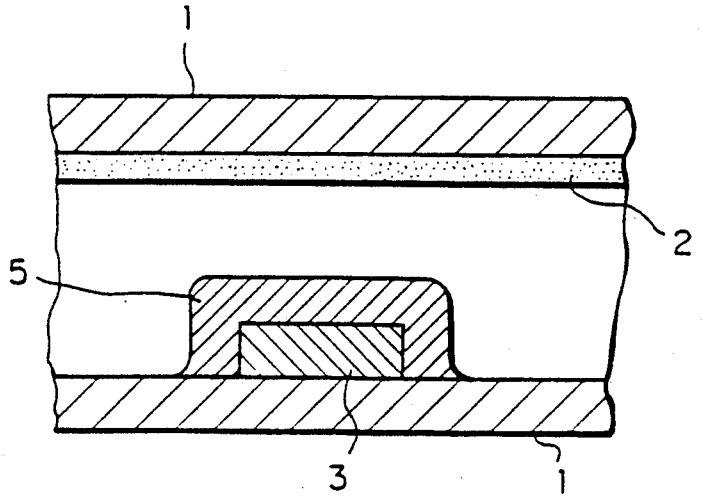
FIG. 4 PRIOR ART
FIG. 4 is a sectional view showing the conventional electrode for discharge light source.

The electrode for discharge light source in an embodiment of the present invention will be explained with reference of FIG. 1, except for those parts which have already been explained earlier and given the same reference numerals as in FIG. 4 which shows the conventional electrode for discharge light source.

What is characteristic of the present invention is that the thickness of the metal conductor 3 is specified and the constituent and thickness of the film 5 of the material for secondary emission, which is formed on the surface of the metal conductor 3, are specified.

According to the first embodiment of the present invention, the metal conductor 3 formed in the discharge container 1 is required to have a thickness ($l_1$) in the range of 1 to 5 μm.

On the surface of the metal conductor 3 having a specified thickness is formed by deposition the film 4 of the material for secondary emission.

The film 4 of the material for secondary emission is required to be made of a compound composed of $LaB_6$ and Ba in an amount of 0.01-20 mol % of $LaB_6$ and is also required to have a thickness ($l_2$) in the range of 0.5-2 μm.

The film 4 of the material for secondary emission made of a compound composed of $LaB_6$ and Ba has good chemical stability and exhibits desirable secondary emission characteristics.

Although Ba can be used as a material for secondary emission on account of its small work function, it is hard to handle because it is so chemically active that it forms BaO or reacts with other constituents when it is applied to the apparatus.

Making Ba chemically stable while leaving intact the characteristic properties of Ba is achieved by creating a compound composed of $LaB_6$ and Ba which is extremely chemically stable and is capable of being formed into a thin film.

$LaB_6$ takes a crystal of chemically stable structure, with La at the center of the body-centered cubic system and also with the center of the octahedron structure made up of six B atoms at each vertex. It is known that $LaB_6$ containing Ba takes exactly the same crystal structure, and both crystals have high melting points (>2100° C).

Figure 2:
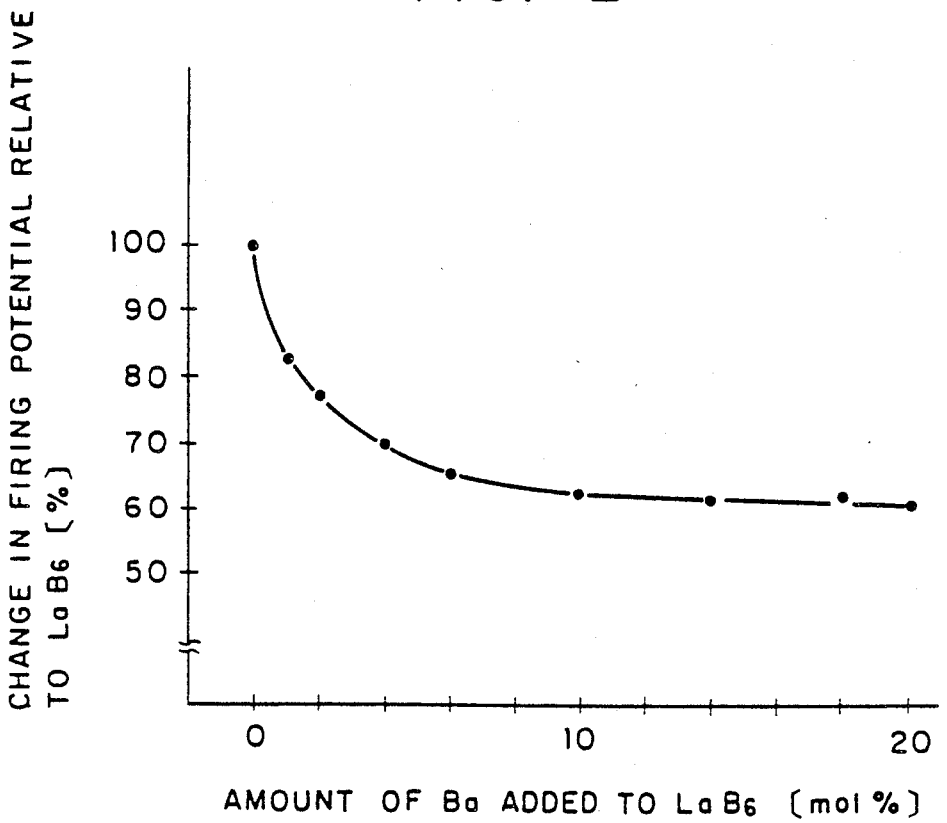
FIG. 2 is a graph showing the relationship between the firing potential and the amount of Ba added to $LaB_6$ used for the electrode for discharge light source as shown in FIG. 1.

FIG. 2 shows the relationship between the firing potential and the amount of Ba added to $LaB_6$. The firing potential was measured using an apparatus equipped with the electrode constructed as mentioned above, containing a rare gas at a pressure of 5-500 Torr, and having a discharge gap of 0.01-100 mm which is much smaller relative to the discharge space.

It is noted from FIG. 2 that the firing potential relatively decreases as the amount of Ba added increases. When $LaB_6$ is incorporated with 20 mol % of Ba, the firing potential decreases by 40% (on average) from that of pure $LaB_6$6. However,, as the amount of Ba added increases, the resulting material for secondary emission becomes less chemically stable and harder to handle.

The above-mentioned material for secondary emission may be formed when Ba displaces a portion of La in $LaB_6$, causing stable La to separate out, or when Ba reacts with a portion of B in $LaB_6$, giving rise to a structure like (La, Ba). However, this displacement or reaction does not take place smoothly if Ba is added in excess of 20 mol %, and the resulting material is chemically unstable.

Therefore, the amount of Ba to be added to $LaB_6$ should be more than 0.01 mol % (at which the firing potential begins to decrease) and less than 20 mol % (which is the upper limit for chemical stability).

The metal conductor 3, on which is formed by deposition the film 4 of the material for secondary emission, should be 1-5 μm thick so that it withstands the discharge current of tens of mA.

The film 4 of the material for secondary emission should have a sufficient thickness in the range of 0.5 to 2 μm so that it is free of pin-holes penetrating to the metal conductor 3.

The thus constructed electrode for discharge light source causes, upon application of a voltage, initial ions to collide with the film 4 of the material for secondary emission, and this collision brings about the secondary emission according to the above-mentioned Hagstrum mechanism and maintains the discharge.

In the course of discharge, the Ba constituting the compound becomes liberated slowly, contributing to the secondary emission. As Ba becomes liberated, La in the separated form changes into stable $LaB_6$. Thus the electrode maintains a good rate of secondary emission. In the case of cold cathode discharge, the above-mentioned discharge takes place according to the Auger mechanism and hence the consumption of Ba is very little and the electrode has an extremely long life.

The following description is about the second embodiment of the present invention, in which the film 4 of the material for second emission is made of a compound composed of $LaB_6$, Ba in an amount of 0.01-20 mol % of $LaB_6$, and Ca in an amount of 0.01-5 mol % of Ba. Incidentally, in the second embodiment, the thickness $l_2$ of the film of the material for secondary emission and the thickness $l_1$ of the metal conductor 3 are the same as those in the first embodiment.

As with the first embodiment, $LaB_6$ takes a crystal of chemically stable structure, with La at the center of the body-centered cubic system and also with the center of the octahedron structure made up of six B atoms at each vertex. It is known that $LaB_6$ containing Ba and Ca takes exactly the same crystal structure, and both crystals have high melting points (>2100° C).

Therefore, La in $LaB_6$ can be displaced by Ba and Ba remains stable Ca relieves the crystalline strain which occurs when La is displaced by Ba. This is explained by the fact that the atom diameter of Ca is 1.97 Å which is close to that of La which is 1.86 Å. (The atom diameter of Ba is 2.25 Å.)

Figure 3:
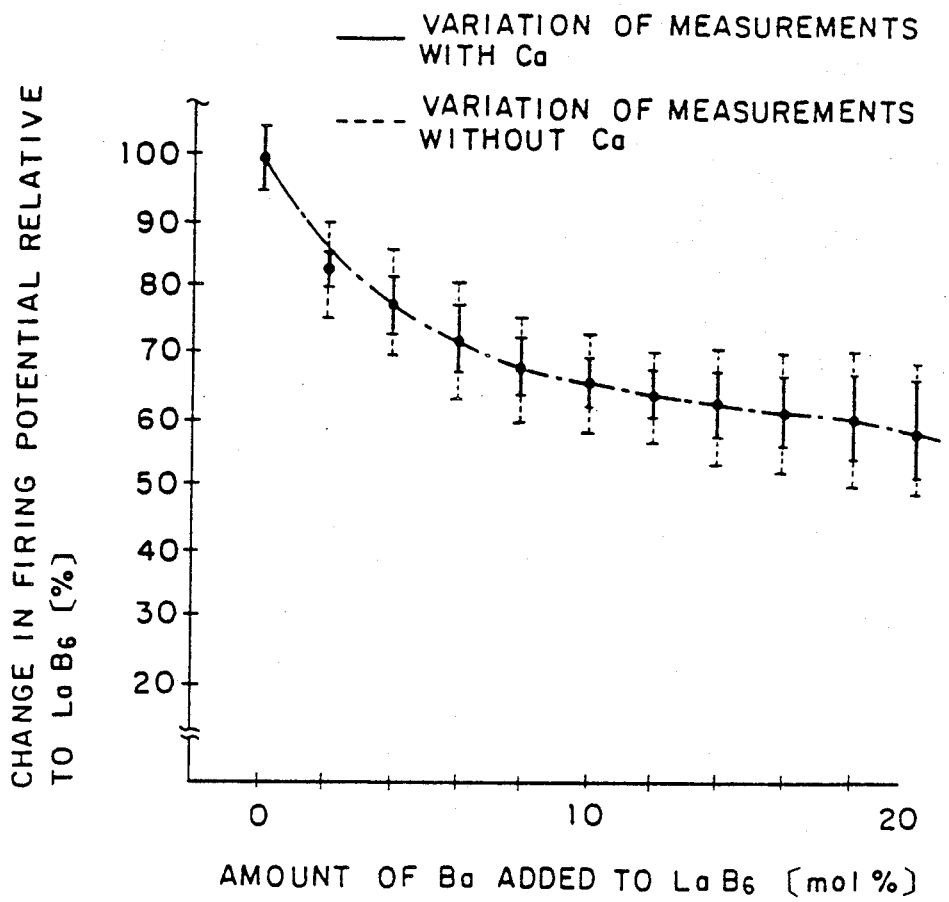
FIG. 3 is a graph showing the relationship between the firing potential and the amount of Ba added to LaB used for the electrode for discharge light source in another embodiment of the present invention.

FIG. 3 shows the relationship between the firing potential and the amount of Ba added to $LaB_6$. The firing potential was measured using an apparatus equipped with the electrode constructed as mentioned above, containing a rare gas at a pressure of 1--500 Torr and having a discharge gap of 0.01-100 mm which is much smaller relative to the discharge space. Changes of the firing potential due to the amount of Ba added to $LaB_6$ and variations of the firing potential after 1000 hours running have been recorded Solid lines indicate the variations of firing potential which occurred when Ca was added, and broken lines indicate the variations of firing potential which occurred when Ca was not added.

It is noted from FIG. 3 that the firing potential relatively decreases as the amount of Ba added increases. When $LaB_6$ is incorporated with b 20 mol % of Ba, the firing potential decreases by 40% (on average) from that of pure $LaB_6$6. However, as the amount of Ba added increases, the resulting material for secondary emission becomes less chemically stable and harder to handle.

The above-mentioned material for secondary emission may be formed when Ba displaces a portion of La in $LaB_6$, causing stable La to separate out, or when Ba and Ca react with a portion of B in $LaB_6$, giving rise to a structure like (La, Ba, Ca). However, this displacement or reaction does not take place smoothly if Ba is added in excess of 20 mol %, and the resulting material is chemically unstable.

Therefore, the amount of Ba to be added to $LaB_6$ should be more than 0.01 mol % (at which the firing potential begins to decrease) and less than 20 mol % (which is the upper limit for chemical stability).

It is also noted that the variations of the firing potential that occurs where Ca is added is about 20% (on average) lower than that where Ca is not added.

The reason for this is that the addition of Ca relieves the crystal strain and increase the chemical stability.

The adequate amount of Ca should preferably be in the range of 0.01 to 5 mol % of Ba; an excessive amount of Ca lowers the effect of Ba.

The metal conductor 3, on which is formed by deposition the film 4 of the material for secondary emission, should be 1-5 μm thick so that it withstands the discharge current of tens of mA.

Therefore, the electrode for discharge light source in the second embodiment maintains a good rate of secondary emission as in the case of that in the first embodiment. In the case of cold cathode discharge, the discharge takes place according to the Auger mechanism and hence the consumption of Ba is very little and the electrode has an extremely long life.

In the above-mentioned embodiments, the film 4 of the material for secondary emission may be formed on the metal conductor 3 by deposition using the electron beam method or sputtering method In addition, the same effect as deposition will be obtained by coating a powder of the material for secondary emission on the metal conductor 3.

The above-mentioned embodiments are concerned with the application to cold cathode discharge; but the present invention will produce the same effect when applied to hot cathode discharge. Capability of exploitation in industry:

As mentioned above, the electrode for discharge light source pertaining to the present invention can withstand the discharge current as large as tens of mA because the metal conductor in the discharge container has a thickness in the range of 1 to 5 μm. Moreover, the electrode for discharge light source has good secondary emission characteristics as well as good heat resistance and chemical stability, because the film of the material for secondary emission is formed on the metal conductor from a compound composed of $LaB_6$ and Ba in an amount of 0.01 to 20 mol % of $LaB_6$. In addition, the film of the material for secondary discharge has a thickness of 0.5 to 2 μm so that it is free of pin-holes and it fully exhibits its performance. The electrode for discharge light source is suitable for discharge display on account of its high reliability and outstanding discharge characteristics.

In the case of the electrode for discharge light source pertaining to another aspect of the present invention, the film of the material for secondary emission is made of a compound composed of $LaB_6$, Ba in an amount of 0.01-20 mol % of $LaB_6$, and Ca in an amount of 0.01-5 mol % of Ba, and is 0.5-2 μm thick. Therefore, the electrode is chemically stable over a long period of time and easy to handle and has an extremely high rate of secondary emission. The electrode has a lower firing potential and a higher energy conversion efficiency, and is suitable for discharge display.

We claim:

1. An electrode for a discharge light source, the electrode comprising a metal conductor located in a discharge container filled with a rare gas and a film of a material for secondary emission formed on the metal conductor, wherein the metal conductor is 1-5 μm thick, and the film of the material for secondary emission includes a compound comprising $LaB_6$ and Ba in an amount of 0.01-20 mol % of $LaB_6$, wherein the film of material is 0.5-2 μm thick.

2. An electrode for discharge light source as claimed in claim 1, wherein the film of the material for secondary emission includes a compound comprising $LaB_6$, Ba in an amount of 0.01-20 mol % of $LaB_6$, and Ca in an amount of 0.01-5 mol % of Ba, wherein the film of material is 0.5-2 μm thick.

* * * * *